United States Patent [19]

Grässer

[11] Patent Number: 4,946,397

[45] Date of Patent: Aug. 7, 1990

[54] ELECTRONIC CONTROL PANEL AND RACK THEREFOR FOR USE IN DATA-PROCESSING SYSTEMS AND THE LIKE

[75] Inventor: Edmond Grässer, Grünstadt, Fed. Rep. of Germany

[73] Assignee: rako electronic-Vertriebsgesellschaft mbH, Grünstadt, Fed. Rep. of Germany

[21] Appl. No.: 192,587

[22] Filed: May 9, 1988

[30] Foreign Application Priority Data

May 9, 1987 [DE] Fed. Rep. of Germany ..... 8706704

[51] Int. Cl.[5] ..... H01R 13/74

[52] U.S. Cl. ..... 439/532; 439/607; 439/716; 439/417

[58] Field of Search ..... 439/545–549, 439/567, 716, 717, 64, 532, 540, 607; 361/417, 419, 420; 211/89, 94, 183

[56] References Cited

U.S. PATENT DOCUMENTS 3,810,433 5/1974 Posner ..... 439/64

3,970,276 7/1976 Debaight ..... 439/716

4,279,459 7/1981 Sherman ..... 439/64

FOREIGN PATENT DOCUMENTS 8518896 8/1987 Fed. Rep. of Germany .

2259268 8/1975 France ..... 439/716

2526261 11/1983 France ..... 361/417

*Primary Examiner*—Gary F. Paumen

*Attorney, Agent, or Firm*—Peter K. Kontler

[57] ABSTRACT

A substantially block-shaped control panel having an elongated metal-coated plastic carrier for one or more modules is separably coupled to a rack in that the end walls of the carrier are formed with parallel slots for tongue-like portions of the rack. The tongue-like portions deform leaf springs which are provided in the end walls and have arcuate intermediate portions extending into the slots to be deformed by and to frictionally engage the respective tongue-like portions. The leaf springs are integral with the respective end walls and are provided with metallic coats, the same as the surfaces bounding the slots and all other external surfaces of the carrier.

17 Claims, 1 Drawing Sheet

ELECTRONIC CONTROL PANEL AND RACK THEREFOR FOR USE IN DATA-PROCESSING SYSTEMS AND THE LIKE

BACKGROUND OF THE INVENTION

The invention relates to improvements in electrical components in general, and more particularly to improvements in electrical components including those known as control panels, plugboards, wiring boards or patch panels (hereinafter called control panels) which can be used with advantage, among others, in data-processing systems to carry arrays of jacks, sockets, plugs and like connectors. Still more particularly, the invention relates to improvements in means for establishing separable connections between control panels and a rack or frame therefor.

It is well known to make the carriers of input and/or output units in the control panels of data-processing systems from a suitable plastic material, such as polyamide. It is further known to employ polyamide for the making of various parts of machines, housings and others including parts which support conductors, terminals and other current conveying elements. A drawback of presently known control panels which are used in data-processing systems and for analogous purposes is that their ability to shield from incident, radiated and/or reflected electromagnetic or electrostatic interference waves or fields is not entirely satisfactory. In addition, presently known control panels are not capable of standing pronounced thermal and/or mechanical stresses.

German Utility Model No. 85 18 896.4 discloses a plastic housing for an electric plug which includes a rectangular bottom section, a cover section and an insert. In order to enhance its shielding properties, the entire housing is metallized and its plastic material is a flame-retardant glass fiber-reinforced 66-polyamide.

OBJECTS AND SUMMARY OF THE INVENTION

An object of the invention is to provide a novel and improved control panel which can be separably secured to a rack, e.g., in a data-processing system, in a simple and reliable manner.

Another object of the invention is to provide a control panel whose carrier of one or more inserts can stand pronounced mechanical and/or thermal stresses and exhibits highly satisfactory shielding properties.

A further object of the invention is to provide a control panel whose carrier for one or more inserts exhibits highly satisfactory shielding properties against incident, reflected and/or radiated electromagnetic or electrostatic interference fields.

An additional object of the invention is to provide a novel and improved combination of the above outlined control panel with a suitable rack, frame or an analogous support.

Still another object of the invention is to provide a control panel which can be coupled to a rack or to another suitable support in a number of different ways.

A further object of the invention is to provide novel and improved means for releasably coupling the above outlined control panel to a rack in a data-processing system or the like.

The invention is embodied in a combination of a rack with a control panel, particularly for use in a data-processing system wherein the control panel is provided with an array of jacks and/or sockets and/or plugs for attachment to input and/or output units of the data-processing system. The control panel comprises two spaced-apart end walls which are provided with guide slots for portions of the rack, and deformable means for releasably holding at least one of the rack portions in the respective slot. The slots are elongated and the holding means preferably comprises a leaf spring which extends longitudinally of and into the respective slot.

The leaf spring preferably comprises a concavo-convex intermediate portion in the respective slot; such intermediate portion is engaged and deformed by the respective portion of the rack when the control panel is installed in the rack.

At least one of the walls can be provided with a recess which communicates with the respective slot, and the leaf spring is preferably disposed in part in the recess of such wall. The latter can include first and second projections which flank the recess, and the leaf spring comprises first and second end portions which are supported by the respective projections of the at least one wall. The end portions of the leaf spring can be reinforced and can be integral with the respective projections. The aforementioned intermediate portion of the leaf spring is disposed between the end portions and extends, at least in part, into the respective slot.

The control panel preferably comprises a carrier which includes the aforementioned walls, and at least one insert which is separably affixed to the carrier. The carrier, its walls and its leaf spring or springs are preferably provided with an external metallic coat which can be applied to the carrier by electroplating. The major part of or the entire carrier (save for its coat of metallic material) can be made of a suitable plastic material, preferably a material which is a flame retardant and can be reinforced, particularly by glass fibers. For example, the plastic material can be polyamide.

The at least one leaf spring of the carrier can be provided with a chamfered edge so that a preferably tongue-like portion of the rack can be slipped into the respective slot by moving at right angles to the longitudinal direction of the slot, or vice versa.

The slots are preferably parallel to each other and are preferably provided in those surfaces of the respective walls which face away from each other. The walls are slidable longitudinally of the slots along the respective portions (e.g., the aforementioned elongated tongues) of the rack, or vice versa.

The novel features which are considered as characteristic of the invention are set forth in particular in the appended claims. The improved control panel itself, however, both as to its construction and the mode of installing the same, together with additional features and advantages thereof, will be best understood upon perusal of the following detailed description of certain specific embodiments with reference to the accompanying drawing.

DESCRIPTION OF PREFERRED EMBODIMENTS

Figure 1:
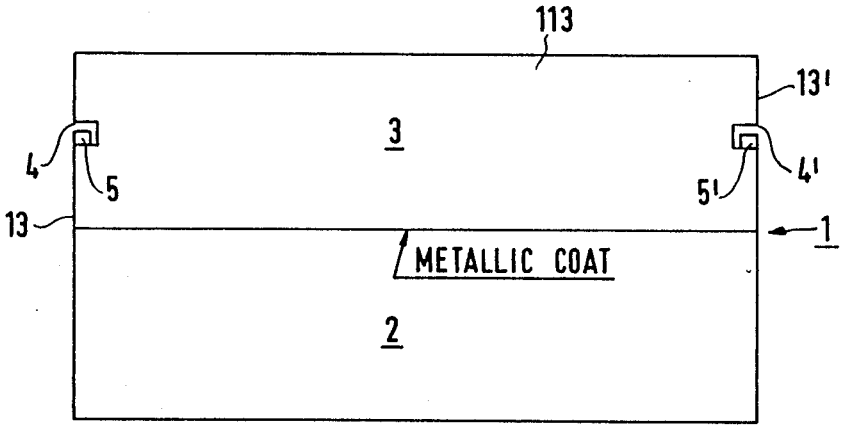
FIG. 1 is a schematic plan view of a control panel embodying the invention.
Figure 2:
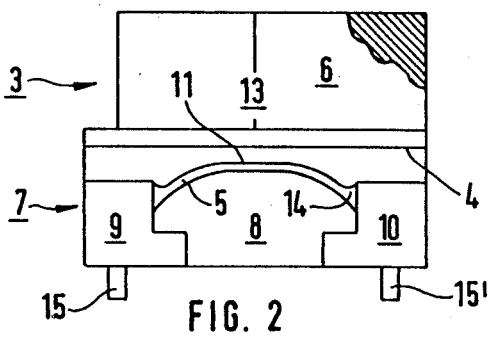
FIG. 2 is an enlarged end elevational view of the carrier of the control panel as seen from the left-hand side of FIG. 1.
Figure 3:
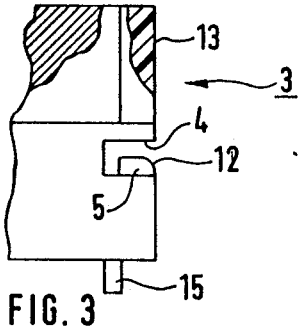
FIG. 3 is a fragmentary plan view of the carrier as seen from the left-hand side of FIG. 2.

FIG. 1 shows an elongated control panel 1 which includes an elongated carrier 3 and an insert 2. The insert 2 can be applied over or inserted into the carrier 3. For example, the insert 2 can include one or more modules and/or other types of attachments which can be assembled with and preferably detached from the carrier 3. FIGS. 2 and 3 show that the carrier 3 has locating stubs 15 and 15' which can be inserted into complementary sockets (not shown) of the insert 2. It is equally possible to provide such stubs on the insert or inserts for reception in complementary sockets of the carrier 3. The stubs 15, 15' can be provided at the corners of the substantially block-shaped carrier 3.

FIGS. 2 and 3 show one end portion of the carrier 3. This end portion includes a transversely extending end wall 13 having a first section 6 at one side and a second section 7 at the other side of an elongated guide groove or slot 4 which is provided in the outer or external surface of the end wall 13, namely in that surface which faces away from the external surface of the other end wall 13'. The walls 13, 13' are disposed at opposite ends of one or more elongated median walls 113 which extend between the walls 13, 13'. For example, the carrier 3 can comprise two parallel elongated median walls whose end portions are connected to each other by the respective end walls 13, 13'.

Figure 4:
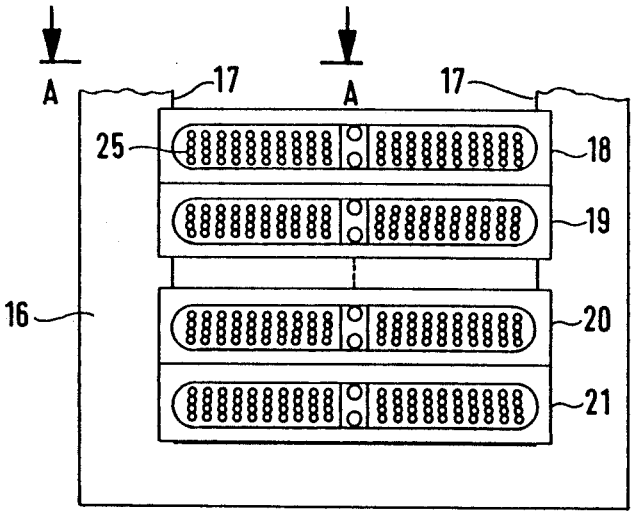
FIG. 4 is a fragmentary front elevational view of a rack with four superimposed control panels installed therein.
Figure 5:
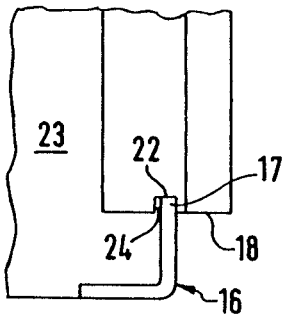
FIG. 5 is a fragmentary plan view as seen in the direction of arrows from the line A—A of FIG. 4.

The external surface of the end wall 13' is provided with an elongated guide slot or groove 4' which is parallel to the slot 4. Each of these slots is bounded by a bottom surface and two preferably parallel lateral surfaces (see particularly FIG. 2). The slots 4 and 4' can receive straight tongue-like portions 17 of a rack or frame 16 which is shown in FIGS. 4 and 5.

The section 7 of the end wall 13 which is shown in FIG. 2 is divided into two projections 9, 10 by a preferably centrally located recess 8 which communicates with the median portion of the respective slot 4. The slot 8 is bridged by the concavo-convex intermediate portion 11 of a leaf spring 5 whose reinforced end portions 14 are supported by and are preferably integral with the respective projections 9, 10 of the section 7. The intermediate portion 11 of the leaf spring 5 extends into the median portion of the slot 4 so that it can be engaged and deformed by the corresponding tongue-like portion 17 of the rack 16 when the carrier 3 is properly installed in the rack. As can be seen in FIG. 3, the leaf spring 5 (or at least its intermediate portion 11) is chamfered at 12, namely adjacent the exposed surface of the respective end wall 13, so that a portion 17 of the rack 16 can be introduced into the slot 4 by moving longitudinally (i.e., from the one toward and beyond the other end) or transversely of the slot. In other words, a tongue-like portion 17 can be introduced into the slot 4 from the right-hand side of FIG. 3 or at right angles to the plane of the drawing. The recess 8 may but need not extend all the way to the external surface of the end wall 13. The other end wall 13', its slot 4', its recess (not shown) and its leaf spring 5' are preferably mirror images of the parts which are shown in FIGS. 2 and 3.

The provision of reinforced end portions 14 constitutes an optional but desirable and advantageous feature of the leaf spring 5 because such reinforced portions can stand pronounced shearing stresses in the regions (immediately adjacent the projections 9 and 10) where the magnitude of shearing stresses, and hence the likelihood of breakage, reaches a maximum value when the slot 4 receives a tongue-like portion 17 which subjects the leaf spring 5 to deforming stresses and is thereby maintained in pronounced frictional engagement with the carrier 3. The leaf spring 5 extends longitudinally of the slot 4. At least a portion of, or even the entire, intermediate portion 11 of the leaf spring 5 is forced into the recess 8 when the slot 4 receives a tongue-like portion 17 of the rack 16.

It is preferred to make the entire carrier 3 of a plastic material (such as 66-polyamide) which can be reinforced by glass fibers or in any other suitable way. Furthermore, the material of the carrier 3 is preferably a flame-retardant plastic substance.

The entire plastic carrier 3, including its leaf springs 5, 5' and the surfaces bounding the slots 4, 4' is provided with an external layer or coat of metallic material. Such coat or layer can be applied by electroplating. In other words, the entire carrier, inclusive of its leaf springs 5 and 5', is capable of conducting current.

FIG. 4 shows four elongated parallel control panels 18, 19, 20 and 21 each of which is or can be identical with the control panel 1 of FIGS. 1 to 3. The frame or rack 16 has two parallel tongue-like portions 17 which extend into the slots (not shown in FIG. 4) of the respective end walls of the control panels 18 to 21. FIG. 5 shows the manner in which one of the portions 17 extends into the adjacent slot 22 (corresponding to the slot 4 or 4' of FIGS. 1–3) of the respective control panel 18. The portions 17 of the rack 16 flank a window for reception of a desired number of control panels. The leaf spring 24 of FIG. 5 corresponds to the leaf spring 5 or 5' and engages the adjacent portion 17 of the rack 16 to maintain the control panel 18 in a selected position.

The reference character 25 denotes in FIG. 4 an array of jacks, sockets and/or plugs which are provided on the control panel 18 for attachment to other parts in a data-processing system or the like. Such jacks, sockets and/or plugs 25 are provided in each of the control panels 18–21, namely in the respective inserts. The rack 16 has a bottom wall 23 which is located behind the window for the control panels 18–21 and carries the portions 17.

As mentioned above, the improved control panels can be used with particular advantage in data-processing and other systems for attachment of input and/or output units of the type which must be satisfactorily shielded from electromagnetic and/or electrostatic interference fields.

An important advantage of the improved control panels and of a combination of such panels with a rack is that the metal-coated leaf springs ensure the establishment of highly satisfactory electrical connections between each carrier and the rack. This ensures that the shielding action against incident, radiated or reflected electromagnetic and/or electrostatic interference fields is highly satisfactory.

While it is also possible to make the carriers of control panels from a metallic material, it is presently preferred to make such carriers of a plastic material and to thereupon provide each carrier (including its leaf springs) with an external coat of metallic material. Plastic carriers can be mass-produced at a fraction of the cost of metallic carriers. Each carrier can be said to constitute an adapter which couples one or more inserts to the rack 16 in a highly reliable manner because the connection is established at both ends of each carrier, i.e., in the regions of both end walls.

The feature that each control panel (1, 18–21) consists of or can consist of several parts, including one or more modules which are attached to the respective carrier, contributes to convenience of assembly and attachment to electric cables.

The utilization of a plastic material which is reinforced, particularly by glass fibers, enhances the impact-resistance of the carriers as well as their resistance to twisting. Carriers which are made of 66-series polyamide also exhibit satisfactory resistance to temperatures and retard the propagation of flames.

It has been found that the fire-retarding properties of a carrier which is made of glass fiber-reinforced polyamide and is coated with a layer of metallic material fully meet the regulations of German DIN (IEC 707/VDE 0303, Part 3) Norms as well as the UL 94 Standard of tests of flammability of plastic materials for parts in devices and appliances of the Underwriters Laboratories, Inc. Moreover, the shielding properties of such plastic carriers and their metallic coats against internal and/or external electromagnetic interference fields fully meet the provisions of the new high-frequency regulations established by the West German Federal Post Office on Jan. 1, 1985. A metallic coat which is applied (such as by electroplating) to a 66-polyamide exhibits a highly satisfactory resistance to rubbing off and/or scratching.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. The combination of a rack with a control panel, said rack supporting said control panel, the combination being particularly for use in a data-processing system wherein the control panel is provided with an array of jacks and/or sockets for attachment to input and/or output units of the data-processing system, said control panel comprising a carrier having two spaced-apart walls provided with elongated guide slots for portions of the rack, at least one insert separably affixed to said carrier, said deformable means for releasably holding at least one of said portions of the rack in the respective slot, said deforming means comprising a leaf spring extending longitudinally of and into the respective slot, said carrier and said walls thereof and said leaf spring having a metallized external surface to enhance the shielding properties of the carrier against incident, reflected and/or radiated electromagnetic or electrostatic interference fields.

2. The combination of claim 1, wherein said leaf spring has a concavo-convex portion in the respective slot.

3. The combination of claim 1, wherein at least one of said walls has a recess communicating with the respective slot and said leaf spring is disposed in part in said recess.

4. The combination of claim 3, wherein said at least one wall includes first and second projections flanking said recess and said leaf spring has first and second end portions supported by the respective projections.

5. The combination of claim 4, wherein said leaf spring further comprises an arcuate intermediate portion extending into the respective slot.

6. The combination of claim 4, wherein the end portions of said leaf spring are integral with the respective projections.

7. The combination of claim 1, wherein said external surface is electroplated.

8. The combination of claim 1, wherein said carrier contains a plastic material.

9. The combination of claim 8, wherein said plastic material is reinforced by glass fibers.

10. The combination of claim 8, wherein said plastic material is polyamide.

11. The combination of claim 8, wherein said plastic material is flame retardant.

12. The combination of claim 1, wherein said leaf spring has a chamfered edge.

13. The combination of claim 1, wherein said panel is elongated and said walls constitute the end walls of said panel.

14. The combination of claim 13, wherein said end walls have surfaces facing away from each other and said guide slots are provided in said surfaces of the respective end walls.

15. The combination of claim 14, wherein said panel has a said leaf spring for each of said slots.

16. The combination of claim 1, wherein said leaf spring has reinforced end portions rigidly mounted to the respective wall.

17. The combination of claim 1, wherein said slots are parallel to each other and said portions of said rack include tongues releasably received in said slots, said walls being slidable longitudinally of said tongues in response to overcoming the bias of said leaf spring.

* * * * *